US006878670B2

(12) United States Patent
Seki et al.

(10) Patent No.: US 6,878,670 B2
(45) Date of Patent: Apr. 12, 2005

(54) HEAT-SENSITIVE RECORDING MATERIAL

(75) Inventors: Shigetoshi Seki, Amagasaki (JP); Toshiro Hata, Amagasaki (JP)

(73) Assignee: OJI Paper Co., Ltd., Tokyo-to (JP)

( * ) Notice: Subject to any disclaimer, the term of this patent is extended or adjusted under 35 U.S.C. 154(b) by 139 days.

(21) Appl. No.: 10/223,616

(22) Filed: Aug. 20, 2002

(65) Prior Publication Data

US 2003/0036478 A1 Feb. 20, 2003

Related U.S. Application Data

(63) Continuation-in-part of application No. 10/146,105, filed on May 16, 2002, now abandoned, which is a continuation of application No. PCT/JP02/04633, filed on May 14, 2002.

(30) Foreign Application Priority Data

May 16, 2001 (JP) ..... 2001-145866
May 14, 2002 (JP) ..... 2002-137905

(51) Int. Cl.[7] ..... B41M 5/20
(52) U.S. Cl. ..... 503/216; 503/217; 503/221
(58) Field of Search ..... 503/216, 217, 503/221

(56) References Cited

U.S. PATENT DOCUMENTS

| | | | | |
|---|---|---|---|---|
| 4,339,492 | A | 7/1982 | Mino et al. | 428/320.4 |
| 4,608,580 | A | 8/1986 | Ikeda et al. | 346/216 |

FOREIGN PATENT DOCUMENTS

| | | | |
|---|---|---|---|
| DE | 100 12 850 | A 1 | 9/2000 |
| EP | 0 098 728 | A2 | 1/1984 |
| JP | 2-20385 | A | 1/1990 |
| JP | 2-249690 | A | 10/1990 |
| JP | 05-092665 | A | 4/1993 |
| JP | 05-169829 | A | 7/1993 |
| JP | 05-254254 | A | 10/1993 |
| JP | 5-254254 | A | 10/1993 |
| JP | 05-278328 | A | 10/1993 |
| JP | 5-286255 | A | 11/1993 |
| JP | 06-255259 | A | 9/1994 |
| JP | 06-320871 | A | 11/1994 |
| JP | 7-172068 | A | 7/1995 |
| JP | 10-278431 | A | 10/1998 |
| JP | 2000-263944 | A | 9/2000 |
| JP | 2001-1647 | A | 1/2001 |
| JP | 2001-088450 | A | 4/2001 |
| JP | 2001-232940 | A | 8/2001 |
| JP | 2001-260541 | A | 9/2001 |
| JP | 2001-301338 | A | 10/2001 |
| JP | 2002-274047 | A | 9/2002 |

*Primary Examiner*—Bruce H. Hess
(74) *Attorney, Agent, or Firm*—Kubovcik & Kubovcik

(57) ABSTRACT

Disclosed is a heat-sensitive recording material comprising a support and a heat-sensitive recording layer formed on the support and containing a leuco dye, a developer and a binder, wherein the heat-sensitive recording material uses as the developer at least two hydroxy-diphenylsulfone compounds such as 4-hydroxy-4'-isopropoxy-diphenylsulfone, 2,4'-dihydroxy-diphenylsulfone and the like, and uses as the leuco dye a black-color-forming leuco dye such as 3-di(n-butyl)amino-6-methyl-7-anilinofluoran or the like and 0.5 to 3.5 wt. %, relative to the black-color-forming leuco dye, of a red-color-forming leuco dye such as 3-diethylamino-7-chlorofluoran or the like.

10 Claims, 1 Drawing Sheet

HEAT-SENSITIVE RECORDING MATERIAL

This application is a continuation-in-part of application Ser. No. 10/146,105, filed May 16, 2002 now abandoned, which is a continuation of PCT/SP 02/04633 filed May 15, 2000.

TECHNICAL FIELD

The present invention relates to a heat-sensitive recording material employing a color forming reaction between a leuco dye and a developer.

BACKGROUND ART

Recording devices, in which a heat-sensitive recording material having a heat-sensitive recording layer containing a leuco dye, a developer and a binder and formed on one side of a support composed of paper, synthetic paper, plastic film or the like is used as a recording media, are compact and inexpensive and are also easy to maintain. Therefore, in addition to being used as recording media in facsimile systems, automatic ticket vending-machines, scientific measuring instruments and so on, they are also extensively used as output media in printers or plotters for POS labels, CAD, CRT medical images and the like.

For printers for CRT medical measuring instruments that require uniformity and high resolution in the recorded images and for CAD plotters that require dimensional stability and fine-line recording, heat-sensitive recording materials employing synthetic papers having multi-layer structures and heat-sensitive recording material employing a biaxially oriented thermoplastic resin film optionally containing inorganic pigments are used.

Expansion of the field of use of such heat-sensitive recording materials has led to an increasing demand for a heat-sensitive recording material in which a recorded portion (i.e., recorded image), formed by a color-forming reaction between a leuco dye and a developer, is excellent in stability against chemicals such as plasticizers, edible oils, cosmetics and the like, and for a heat-sensitive recording material which gives a recorded portion exhibiting less change over time in density.

Heat-sensitive recording materials, in which at least two kinds of hydroxy-diphenylsulfone compounds such as 4-hydroxy-4'-isopropoxydiphenylsulfone, 4,4'-dihydroxydiphenylsulfone and the like are used as a developer to increase the stability of a recorded portion, are disclosed in Japanese Unexamined Patent Publications Nos. 1990-020385, 1990-249690, 1993-286255, 1995-172068, 2000-263944 and 2001-001647. However, there are further demands for less change in the density of a recorded portion over time caused by humidity and temperature, and for improved gradation of the recorded portion.

In some applications, heat-sensitive recording materials are required to give a recorded portion with an achromatic black color (or pale charcoal color, gray). Japanese Unexamined Patent Publications Nos. 1993-254254 and 1996-324130 disclose heat-sensitive recording materials in which a combination of a black-color-forming leuco dye and a red-color-forming leuco dye is used to give such an achromatic black color to a recorded portion thereof. However, in such heat-sensitive recording materials, further improvements are demanded in the recording sensitivity and the hue or gradation of a recorded portion thereof.

The term "gradation" employed herein means that the recording energy applied and the density (optical density) of the recorded portion (recorded image) are substantially directly proportional (linearly proportional). More specifically, a recorded image is formed with a density proportional to the intensity of recording energy applied; and the density of the recorded portion (recorded image) and the recording energy applied are in a nearly linear relationship. As a result, when multiple recorded portions (recorded images) are formed by changing (increasing or decreasing) the intensity of the recording energy applied in a stepwise manner, the resulting recorded portions (recorded images) exhibit clear gradation throughout their density range (from the lowest density to the highest density). Excellent gradation leads to excellent image quality.

DISCLOSURE OF THE INVENTION

An object of the invention is to provide a heat-sensitive recording material in which the hue of the recorded portion (recorded image) is a nearly achromatic black color, the recorded portion (recorded image) is excellent in gradation, and the density of the recorded portion exhibits substantially no change over time under the influence of humidity or temperature.

As a means to achieve the above object in a heat-sensitive recording material having a heat-sensitive recording layer containing a leuco dye, a developer and a binder on a support, the present invention uses at least two kinds of hydroxy-diphenylsulfone compounds as the developer and also uses as the leuco dye a black-color-forming leuco dye and 0.5 to 3.5 wt. %, relative to the black-color-forming leuco dye, of a red-color-forming leuco dye.

Particularly, the present invention provides the following heat-sensitive recording materials.

Item 1. A heat-sensitive recording material comprising (a) a support and (b) a heat-sensitive recording layer formed on the support and containing a leuco dye, a developer and a binder, the heat-sensitive recording layer containing at least two hydroxy-diphenylsulfone compounds as the developer and a black-color-forming leuco dye and a red-color-forming leuco dye as the leuco dye, the red-color-forming leuco dye being present in an amount of 0.5 to 3.5 wt. % relative to the black-color-forming leuco dye.

Item 2. The heat-sensitive recording material according to Item 1 wherein the hydroxy-diphenylsulfone compounds are a mixture of 4-hydroxy-4'-isopropoxy-diphenylsulfone and at least one member selected from the group consisting of 2,4'-dihydroxy-diphenylsulfone and 4,4'-dihydroxy-diphenylsulfone.

Item 3. The heat-sensitive recording material according to Item 2 wherein said at least one member selected from the group consisting of 2,4'-dihydroxy-diphenylsulfone and 4,4'-dihydroxy-diphenylsulfone is used in an amount of about 0.5 to about 2.0 parts by weight per part by weight of 4-hydroxy-4'-isopropoxy-diphenylsulfone.

Item 4. The heat-sensitive recording material according to Item 1 wherein the black-color-forming leuco dye is at least one member selected from the group consisting of 3-di(n-butyl)amino-6-methyl-7-anilinofluoran, 3-di(n-pentyl)amino-6-methyl-7-anilinofluoran and 3-di(n-butyl)amino-7-(o-chloroanilino)fluoran.

Item 5. The heat-sensitive recording material according to Item 4 wherein the black-color-forming leuco dye is a mixture of 3-di(n-butyl)amino-7-(o-chloroanilino)fluoran and at least one member selected from the group consisting of 3-di(n-butyl)amino-6-methyl-7-anilinofluoran and 3-di(n-pentyl)amino-6-methyl-7-anilinofluoran.

Item 6. The heat-sensitive recording material according to Item 5 wherein 3-di(n-butyl)amino-7-(o-chloroanilino)

fluoran is used in an amount of 30 to 300 wt. % relative to said at least one member selected from the group consisting of 3-di(n-butyl)amino-6-methyl-7-anilinofluoran and 3-di (n-pentyl)amino-6-methyl-7-anilinofluoran.

Item 7. The heat-sensitive recording material according to Item 1 wherein the red-color-forming leuco dye is 3-diethylamino-7-chlorofluoran.

Item 8. The heat-sensitive recording material according to Item 1 which contains the red-color-forming leuco dye in an amount of about 0.8 to about 3.0 wt. % relative to the black-color-forming leuco dye.

Item 9. The heat-sensitive recording material according to Item 1 wherein the heat-sensitive recording layer further comprises a blue-color-forming leuco dye in an amount of about 0.5 to 5 wt. % relative to the black-color-forming leuco dye.

Item 10. The heat-sensitive recording material according to Item 1 wherein a water dispersible resin is contained as the binder in the heat-sensitive recording layer.

Item 11. The heat-sensitive recording material according to Item 1 wherein the heat-sensitive recording layer further comprises a sensitizer, a print stability-improving agent or a mixture thereof.

Item 12. The heat-sensitive recording material according to Item 1 which further comprises a protective layer formed on the heat-sensitive recording layer.

DETAILED DESCRIPTION OF THE INVENTION

Figure 1:
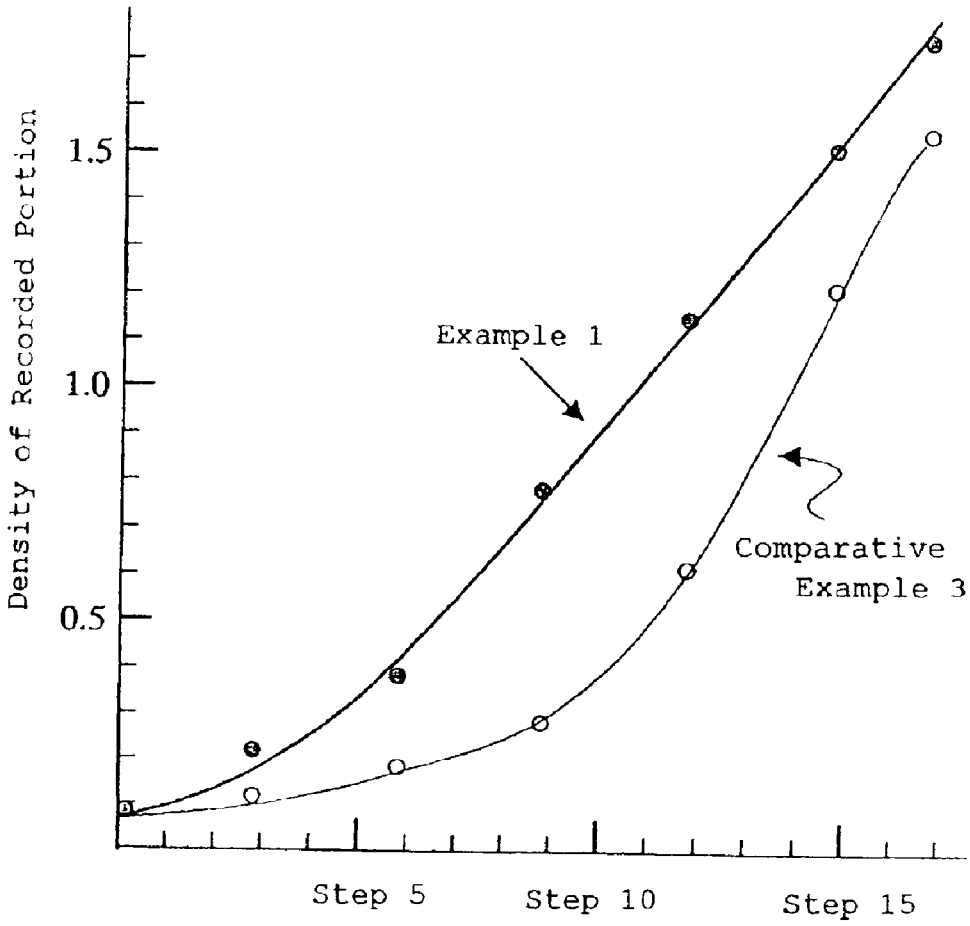
FIG. 1 is a graph illustrating the relationship between the intensity of the recording energy applied and the density of the recorded portion with respect to the heat-sensitive recording materials of Example 1 and Comparative Example 3.

As stated above, the present invention is characterized in that the heat-sensitive recording layer contains at least two hydroxy-diphenylsulfone compounds as a developer, and contains at least a black-color-forming leuco dye and 0.5 to 3.5 wt. %, based on the black-color-forming leuco dye, of a red-color-forming leuco dye.

Developer

In the invention, excellent gradation and long-term stability of a recorded portion are obtained by the combined use of at least two hydroxy-diphenylsulfone compounds as a developer.

Hydroxy-diphenylsulfone Compounds

Specific examples of the hydroxy-diphenylsulfone compounds include 4-hydroxy-4'-methoxy-diphenylsulfone, 4-hydroxy-4'-isopropoxy-diphenylsulfone, 4-hydroxy-4'-n-propoxy-diphenylsulfone, 4-hydroxy-4'-benzyloxy-diphenylsulfone, 2,4'-dihydroxy-diphenylsulfone, 4,4'-dihydroxy-diphenylsulfone, 3,3'-diallyl-4,4'-dihydroxy-diphenylsulfone, 3,4-dihydroxy-4'-methyl-diphenylsulfone, 2,2'-[4-(4-hydroxyphenylsulfonyl)phenoxy]diethylether and the like.

Among them, preferable is the combined use of 4-hydroxy-4'-isopropoxy-diphenylsulfone and at least one member selected from the group consisting of 2,4'-dihydroxy-diphenylsulfone and 4,4'-dihydroxy-diphenylsulfone.

Particularly, the use of about 0.2 to about 5.0 parts by weight, especially about 0.5 to about 2.0 parts by weight, of at least one member selected from the group consisting of 2,4'-dihydroxy-diphenylsulfone and 4,4'-dihydroxy-diphenylsulfone per part by weight of 4-hydroxy-4'-isopropoxy-diphenylsulfone gives a nearly achromatic black color even in low density recorded portions having an optical density of 0.4 to 0.8.

Among 2,4'-dihydroxy-diphenylsulfone and 4,4'-dihydroxy-diphenylsulfone, 2,4'-dihydroxy-diphenylsulfone is preferred because it imparts better resistance to background fogging.

The total amount of the hydroxy-diphenylsulfone compounds used is about 15 to about 60 wt. %, preferably about 20 to about 50 wt. %, relative to the total solids of the heat-sensitive recording layer.

Other Developers

The heat-sensitive recording layer contains the above-mentioned hydroxy-diphenylsulfone compounds as a developer, and if necessary, various other known developers can additionally be used insofar as the desired effects of the invention are not impaired.

Examples of other developers include phenolic compounds such as 1,3,3-trimethyl-1-(p-hydroxyphenyl)-6-hydroxyindan, 4,4'-isopropylidenediphenol, 4,4'-cyclohexylidenediphenol, 2,2-bis(4-hydroxyphenyl)-4-methylpentane, benzyl 4-hydroxybenzoate, 1,1-bis(4-hydroxyphenyl)-1-phenylethane and the like; those having one or more —$SO_2NH$— bonds within the molecule, such as p-cumylphenyl N-(p-tolylsulfonyl)carbamate, N-(o-tolyl)-p-tolylsulfoamide, 4,4'-bis(N-p-tolylsulfonylamino-carbonylamino)diphenylmethane and the like; zinc salts of aromatic carboxylic acids such as zinc 4-[2-(p-methoxyphenoxy)ethyloxy]salicylate, zinc 4-[3-(p-tolylsulfonyl)propyloxy]salicylate, zinc 5-[p-(2-p-methoxyphenoxyethoxy)cumyl]salicylate and the like.

The amount of said other developers is suitably selected, but usually ranges from about 3 to about 15 wt. %, particularly from about 5 to about 10 wt. %, relative to the total amount of the above hydroxy-diphenylsulfone compounds used.

Leuco Dye

The heat-sensitive recording layer of the heat-sensitive recording material of the invention contains at least a black-color-forming leuco dye and a specified amount of a red-color-forming leuco dye. In the invention, recorded portions excellent in hue, gradation and background-fogging resistance, and also excellent in heat resistance and moisture resistance are obtained by the combined use of a black-color-forming leuco dye and a specified amount of a red-color-forming leuco dye, in addition to the use of at least two hydroxy-diphenylsulfone compounds described above.

Black-color-forming Leuco Dyes

Specific examples of black-color-forming leuco dyes used in the heat-sensitive recording layer include a wide variety of known black-color-forming leuco dyes used in the art, such as 3-(N-ethyl-N-isoamyl)amino-6-methyl-7-anilinofluoran, 3-(N-methyl-N-cyclohexyl)amino-6-methyl-7-anilinofluoran, 3-diethylamino-6-methyl-7-anilinofluoran, 3-di(n-butyl)amino-6-methyl-7-anilinofluoran, 3-di(n-pentyl)amino-6-methyl-7-anilinofluoran, 3-di(n-butyl) amino-7-(o-chloroanilino)fluoran, 3-di(n-butyl)amino-7-(o-fluoroanilino)fluoran, 3-(N-ethyl-p-toluidino)-6-methyl-7-anilinofluoran, 3-(N-ethyl-N-tetrahydrofurfuryl)amino-6-methyl-7-anilinofluoran, 3-diethylamino-6-chloro-7-anilinofluoran, 3-pyrrolidino-6-methyl-7-anilinofluoran, 3-piperidino-6-methyl-7-anilinofluoran and the like.

Among them, at least one member selected from the group consisting of 3-di(n-butyl)amino-6-methyl-7-anilinofluoran, 3-di(n-pentyl)amino-6-methyl-7-anilinofluoran and 3-di(n-butyl)amino-7-(o-chloroanilino) fluoran is preferable for imparting excellent gradation of the recorded portions and excellent background-fogging resistance.

Especially preferable is the use of 3-di(n-butyl)amino-7-(o-chloroanilino)fluoran in combination with at least one member selected from the group consisting of 3-di(n-butyl) amino-6-methyl-7-anilinofluoran and 3-di(n-pentyl)amino-6-methyl-7-anilinofluoran.

In this case, it is preferable to use 3-di(n-butyl)amino-7-(o-chloroanilino)fluoran in an amount of about 30 to about 300 wt. %, more preferably about 50 to about 150 wt. %, relative to at least one member selected from the group consisting of 3-di(n-butyl)amino-6-methyl-7-anilinofluoran and 3-di(n-pentyl)amino-6-methyl-7-anilinofluoran.

Red-color-forming Leuco Dyes

Specific examples of red-color-forming leuco dyes used in the heat-sensitive recording layer are suitably selected from a wide range of red-color-forming leuco dyes known in the art, such as 3,3'-bis(p-dimethylaminophenyl)phthalide, 3-(N-ethyl-N-isoamyl)amino-7-phenoxyfluoran, 3-cyclohexylamino-6-chlorofluoran, 3-diethylamino-6-methyl-7-chlorofluoran, 3-diethylamino-7,8-benzofluoran, 3-diethylamino-7-chlorofluoran, rhodamine(o-chloroanilino)lactam, 3-diethylamino-6,8-dimethylfluoran, 3,3'-bis(1-n-butyl-2-methylindol-3-yl)phthalide and the like. Among them, 3-diethylamino-7-chlorofluoran is preferable.

Leuco dyes are not limited to those specified above, and two or more black-color-forming leuco dyes and two or more red-color-forming leuco dyes may also be used in combination.

In the invention, the red-color-forming leuco dye is employed in an amount of 0.5 to 3.5 wt. % relative to the black-color-forming leuco dye. Low-density recorded portions having an optical density of 0.2 to 0.6 is likely to have a black color with a greenish hue when the red-color-forming leuco dye is used in an amount of less than 0.5 wt. %, and is likely to have a black color with a reddish hue when it is used in an amount of more than 3.5 wt. %. Therefore, the amount of the red-color-forming leuco dye is preferably about 0.8 to about 3.0 wt. %, more preferably about 1.0 to about 2.0 wt. %, relative to the black-color-forming leuco dye.

Other Leuco Dyes

Moreover, the heat-sensitive recording layer may contain other leuco dyes insofar as the desired effects of the invention are not impaired. Specific examples of such leuco dyes include blue-color-forming leuco dyes such as 3,3-bis(p-dimethylaminophenyl)-6-dimethylaminophthalide, 3-(4-diethylamino-2-methylphenyl)-3-(4-dimethylaminophenyl)-6-dimethylaminophthalide, 3-diethylamino-7-dibenzylamino-benzo[a]fluoran and the like;

green-color-forming leuco dyes such as 3-(N-ethyl-N-p-tolyl)amino-7-N-methylanilinofluoran, 3-diethylamino-7-anilinofluoran, 3-diethylamino-7-dibenzylaminofluoran and the like; and leuco dyes having absorption wavelengths in the near infrared region such as 3,3-bis[1-(4-methoxyphenyl)-1-(4-dimethylaminophenyl)ethylen-2-yl]-4,5,6,7-tetrachlorophthalide, 3-p-(p-dimethylaminoanilino) anilino-6-methyl-7-chlorofluoran, 3-p-(p-chloroanilino) anilino-6-methyl-7-chlorofluoran, 3,6-bis (dimethylamino)fluorene-9-spiro-3'-(6'-dimethylamino) phthalide and the like.

These other leuco dyes are preferably used in an amount of about 0.3 to about 15 wt. %, especially about 0.5 to about 10 wt. %, relative to the black-color-forming leuco dye. Particularly, in the invention, the blue-color-forming leuco dye is preferably used in an amount of about 0.5 to about 5 wt. %, especially about 1.0 to about 3.0 wt. %, relative to the black-color-forming leuco dye.

In the invention, the total amount of black-color-forming leuco dye and red-color-forming leuco dye used preferably is about 5 to about 35 wt. %, especially about 10 to about 25 wt. %, relative to the total solids content of the heat-sensitive recording layer.

Heat-sensitive Recording Layer

The heat-sensitive recording layer is formed, for example, as follows. A black-color-forming leuco dye, a red-color-forming leuco dye, a developer comprising at least two hydroxy-diphenylsulfone compounds, and if desired, a sensitizer, a print stability-improving agent and the like are pulverized usually in water serving as a dispersion medium, either jointly or separately, by means of a ball mill, an attritor, a sand mill or like mixing and pulverizing apparatus to an average particle diameter of about 2 $\mu$m or less. Then a binder is added to the resulting dispersion, giving a heat-sensitive recording layer coating composition. The coating composition is applied to a support, and the coating is dried.

Examples of such binders include water-soluble resins such as graft copolymers of starch and polyvinyl acetate, polyvinyl alcohol, carboxy-modified polyvinyl alcohol, acetoacetyl-modified polyvinyl alcohol, silicon-modified polyvinyl alcohol, oxidized starch, casein, styrene-maleic anhydride copolymer, methylvinylether-maleic anhydride copolymer, isobutylene-maleic anhydride copolymer and the like; and water-dispersible resins such as styrene-butadiene-based latex, acrylic latex, urethane-based latex and the like. Among them, water-dispersible resins are preferred. The amount of the binder to be employed is not particularly limited but is preferably about 5 to about 40 wt. %, especially about 20 to about 35 wt. %, relative to the heat-sensitive recording layer.

Further, the heat-sensitive recording layer may contain a sensitizer to optimize the recording sensitivity and a print stability-improving agent to enhance the long-term stability of recorded portions.

Examples of sensitizers include stearic acid amide, methylenebisstearamide, dibenzyl terephthalate, benzyl p-benzyloxybenzoate, 2-naphthyl benzyl ether, m-terphenyl, p-benzylbiphenyl, p-tolyl biphenyl ether, di(4-methoxyphenoxyethyl)ether, 1,2-di(3-methylphenoxy) ethane, 1,2-di(4-methylphenoxy)ethane, 1,2-di(4-methoxyphenoxy)ethane, 1,2-di(4-chlorophenoxy)ethane, 1,2-diphenoxyethane, 1-(4-methoxyphenoxy)-2-(3-methylphenoxy)ethane, p-methylthiophenylbenzyl ether, di(β-biphenylethoxy)benzene, di(p-chlorobenzyl) oxalate, dibenzyl oxalate and the like.

Examples of print stability-improving agents include hindered phenol compounds such as 2,2'-methylenebis(4-methyl-6-tert-butylphenol), 4,4'-thiobis(2-methyl-6-tert-butylphenol), 4,4'-butylidenebis(6-tert-butyl-m-cresol), 1,3,5-tris(4-tert-butyl-3-hydroxy-2,6-dimethylbenzyl) isocyanuric acid, 1,1,3-tris(2-methyl-4-hydroxy-5-tert-butylphenyl)butane, 1,1,3-tris(2-methyl-4-hydroxy-5-cyclohexylphenyl)butane, 2,2-bis(4-hydroxy-3,5-dibromophenyl)propane, 2,2-bis(4-hydroxy-3,5-dimethylphenyl)propane and the like; and epoxy compounds such as 4,4!-diglycidyloxydiphenylsulfone, 4-benzyloxy-4'-(2-methylglycidyloxy)diphenylsulfone, diglycidyl terephthalate, cresol novolac epoxy resin, phenol novolac epoxy resin, bisphenol A-based epoxy resin and the like.

The amounts of the sensitizer and the print stability-improving agent employed are not particularly limited; but each of the amounts thereof is usually about 0.1 to about 4 parts by weight, preferably about 0.5 to about 3 parts by weight, per part by weight of the total amount of the leuco dyes contained in the heat-sensitive recording layer.

Moreover, the heat-sensitive recording layer coating composition may contain various auxiliaries if so desired. Examples of such auxiliaries include pigments such as kaolin, precipitated calcium carbonate, ground calcium carbonate, calcined kaolin, titanium oxide, magnesium carbonate, aluminium hydroxide, amorphous silica, urea-formalin resin filler and the like; surfactants such as sodium dioctylsulfosuccinate, sodium dodecylbenzenesulfonate, sodium lauryl sulfate, fatty acid metal salts and the like; waxes such as zinc stearate, calcium stearate, polyethylene wax, carnauba wax, paraffin wax, ester wax and the like; insolubilizers such as glyoxal, urea formalin resin, polyamide epoxy resin, polyamideamine-epichlorohydrin resin, adipic dihydrazide, boric acid, borax, ammonium zirconium carbonate and the like; and ultraviolet absorbers, antifoaming agents, fluorescent dyes, coloring dyes and the like.

The heat-sensitive recording layer coating composition is applied in an amount of about 2 to about 12 g/m$^2$, preferably about 3 to about 7 g/m$^2$, on a dry weight basis.

The heat-sensitive recording layer coating composition is applied to a support according to a coating method conventionally used in the art such as air knife coating, pure blade coating, rod blade coating, bar coating, curtain coating, die coating, gravure coating or the like, and then the resulting coating layer is dried.

Support

As the aforementioned support, any known supports used in the art can be used. Especially, examples include deinked pulp-containing recycled paper, neutralized or acidic wood-free paper, coated paper, synthetic paper, transparent plastic film, colored transparent plastic film, white plastic film and the like. The thickness of these supports is suitably selected from a wide range. Preferable thickness is generally about 40 to about 250 $\mu$m.

Protective Layer

If desired, a protective layer may be provided on the heat-sensitive recording layer to enhance chemical resistance or water resistance of the recorded portion, or to improve runnability during recording. Such a protective layer is formed, for example, by applying to the heat-sensitive recording layer a protective layer coating composition which contains a binder with film-forming ability, and drying the resulting layer.

As a binder which may be contained in the protective layer coating composition, those binders which can be incorporated in the above heat-sensitive recording layer coating composition may be used. Such binder is preferably used in an amount of about 20 to about 100 wt. %, especially about 30 to about 95 wt. %, based on the total solids content of the protective layer.

Further, the protective layer coating composition may contain, if necessary, the aforementioned various auxiliaries which may be incorporated into the heat-sensitive recording layer coating composition.

The protective layer coating composition is applied in an amount of about 0.5 to about 10 g/m$^2$, preferably about 1 to about 5 g/m$^2$, on a dry weight basis.

The protective layer coating composition can be applied to the heat-sensitive recording layer according to a coating method known in the art such as air knife coating, pure blade coating, rod blade coating, bar coating, curtain coating, die coating, gravure coating or the like, and then the resulting coating layer is dried.

Moreover, in order to enhance the recording sensitivity and the image quality, an undercoat layer containing oil-absorbing pigments or hollow particles as main components may be provided between the support and the heat-sensitive recording layer; a glossy layer may be provided by applying to the protective layer a coating composition containing an electron beam- or UV-curable compound as a main component and curing the coating by an electron beam or a UV ray; or a smoothing treatment may be provided by a supercalender after the formation of each layer. Furthermore, the heat-sensitive recording material of the present invention may be modified, if necessary, by utilizing a variety of other known techniques used in the production of heat-sensitive recording materials.

EXAMPLES

The present invention will be illustrated in further detail with reference to Examples below. It should be understood that the scope of the invention is not limited by the Examples. Herein, "parts" and "%" represent "parts by weight" and "% by weight", respectively, unless otherwise specified.

Example 1

Preparation of Developer Dispersion (Dispersion A)

A composition composed of 10 parts of 4-hydroxy-4'-isopropoxy-diphenylsulfone, 4 parts of a 10% aqueous solution of sulfone-modified polyvinyl alcohol and 8 parts of a 5% aqueous solution of hydroxypropyl methylcellulose was pulverized by an Ultra Visco Mill (manufactured by Aymex Co., Ltd.) to an average particle diameter of 1.5 $\mu$m, giving Dispersion A.

Preparation of Developer Dispersion (Dispersion B)

A composition composed of 10 parts of 2,4'-dihydroxy-diphenylsulfone, 4 parts of a 10% aqueous solution of sulfone-modified polyvinyl alcohol and 8 parts of a 5% aqueous solution of hydroxypropyl methylcellulose was pulverized by an Ultra Visco Mill (manufactured by Aymex Co., Ltd.) to an average particle diameter of 1.5 $\mu$m, giving Dispersion B.

Preparation of Black-color-forming Leuco Dye Dispersion (Dispersion C)

A composition composed of 10 parts of 3-di(n-butyl) amino-6-methyl-7-anilinofluoran, 10 parts of a 10% aqueous solution of sulfone-modified polyvinyl alcohol and 10 parts of water was pulverized by an Ultra Visco Mill (manufactured by Aymex Co., Ltd.) to an average particle diameter of 1.0 μm, giving Dispersion C.

Preparation of Black-color-forming Leuco Dye Dispersion (Dispersion D)

A composition composed of 10 parts of 3-di(n-butyl) amino-7-(o-chloroanilino)fluoran, 10 parts of a 10% aqueous solution of sulfone-modified polyvinyl alcohol and 10 parts of water was pulverized by an Ultra Visco Mill (manufactured by Aymex Co., Ltd.) to an average particle diameter of 1.0 μm, giving Dispersion D.

Preparation of Red-color-forming Leuco Dye Dispersion (Dispersion E)

A composition composed of 10 parts of 3-diethylamino-7-chlorofluoran, 10 parts of a 10% aqueous solution of sulfone-modified polyvinyl alcohol and 10 parts of water was pulverized by an Ultra Visco Mill (manufactured by Aymex Co., Ltd.) to an average particle diameter of 1.0 μm, giving Dispersion E.

Preparation of Blue-color-forming Leuco Dye Dispersion (Dispersion F)

A composition composed of 10 parts of 3,3-bis(p-dimethylaminophenyl)-6-dimethylaminophthalide, 10 parts of a 10% aqueous solution of sulfone-modified polyvinyl alcohol and 10 parts of water was pulverized by an Ultra Visco Mill (manufactured by Aymex Co., Ltd.) to an average particle diameter of 1.0 μm, giving Dispersion F.

Preparation of Sensitizer Dispersion (Dispersion G)

A composition composed of 10 parts of 1,2-di(3-methylphenoxy)ethane, 10 parts of a 10% aqueous solution of sulfone-modified polyvinyl alcohol and 10 parts of water was pulverized by an Ultra Visco Mill (manufactured by Aymex Co., Ltd.) to an average particle diameter of 1.5 μm, giving Dispersion G.

Preparation of Heat-sensitive Recording Layer Coating Composition

A heat-sensitive recording layer coating composition was prepared by stirring a composition composed of 30 parts of Dispersion A, 30 parts of Dispersion B, 30 parts of Dispersion C, 30 parts of Dispersion D, 0.6 part of Dispersion E, 1.0 part of Dispersion F, 18 parts of Dispersion G, 45 parts of stylene-butadiene latex (glass transition temperature: −5° C., solids content: 48%), 95 parts of a 13% aqueous solution of polyvinyl alcohol (trade name: PVA105, manufactured by Kuraray Co., Ltd.), 12 parts of amorphous silica (trade name: Mizukasil P-527, manufactured by Mizusawa Industrial Chemicals, Ltd.) and 60 parts of water.

Preparation of Protective Layer Coating Composition

A protective layer coating composition was prepared by stirring a composition composed of 70 parts of a 60% aqueous slurry of kaolin (average particle diameter: 0.8 μm), 15 parts of an aqueous dispersion of zinc stearate (trade name: Hidorin Z-7-30, solids content: 31.5%), 2.00 parts of a 10% aqueous solution of acetoacetyl-modified polyvinyl alcohol (trade name: Gohsefimer Z-200, manufactured by The Nippon Synthetic Chemical Industry Co., Ltd.), 3 parts of a 10% aqueous solution of glyoxal and 120 parts of water.

Preparation of Heat-sensitive Recording Material

A heat-sensitive recording material was prepared by applying to one side of a synthetic paper (trade name: Yupo FPG-80, manufactured by Yupo Corporation) the heat-sensitive recording layer coating composition and the protective layer coating composition in such amounts that the respective amounts after drying would be 5 g/m$^2$ and 3 g/m$^2$, and drying the resulting coating layers. After formation of the protective layer, the heat-sensitive recording material was subjected to a smoothing treatment by a supercalender.

Examples 2 to 11 and Comparative Examples 1 to 4

Preparation of Developer Dispersion (Dispersion H)

A composition composed of 10 parts of 4,4'-dihydroxydiphenylsulfone, 4 parts of a 10% aqueous solution of sulfone-modified polyvinyl alcohol and 8 parts of a 5% aqueous solution of hydroxypropyl methylcellulose was pulverized by an Ultra Visco Mill (manufactured by Aymex Co., Ltd.) to an average particle diameter of 1.5 μm, giving Dispersion H.

Sensitizer Dispersion (Dispersion I)

A commercially available stearic acid amide dispersion (trade name: Himicron G-270, solids content: 21%, manufactured by Chukyo Yushi Co., Ltd.) was used as Dispersion I.

Heat-sensitive recording materials were prepared in the same manner as in Example 1, except that the components and the proportions thereof were selected as shown in Table 1 instead of using 30 parts of Dispersion A, 30 parts of Dispersion B, 30 parts of Dispersion C, 30 parts of Dispersion D, 0.6 part of Dispersion E, 1.0 part of Dispersion F and 18 parts of Dispersion G.

TABLE 1

| | Developer dispersion | Leuco dye dispersion | Sensitizer dispersion |
|---|---|---|---|
| Example 2 | Dispersion A (30 parts) + Dispersion H (30 parts) | Dispersion C (30 parts) + Dispersion D (30 parts) + Dispersion E (0.6 part) + Dispersion F (1 part) | Dispersion G (18 parts) |
| Example 3 | Dispersion A (20 parts) + Dispersion B (40 parts) | Dispersion C (30 parts) + Dispersion D (30 parts) + Dispersion E (0.6 part) + Dispersion F (1 part) | Dispersion G (18 parts) |
| Example 4 | Dispersion A (40 parts) + Dispersion B (20 parts) | Dispersion C (30 parts) + Dispersion D (30 parts) + Dispersion E (0.6 part) + Dispersion F (1 part) | Dispersion G (18 parts) |

TABLE 1-continued

| | Developer dispersion | Leuco dye dispersion | Sensitizer dispersion |
|---|---|---|---|
| Example 5 | Dispersion A (30 parts) + Dispersion B (30 parts) | Dispersion C (60 parts) + Dispersion E (0.6 parts) + Dispersion F (1 part) | Dispersion G (18 parts) |
| Example 6 | Dispersion A (30 parts) + Dispersion B (30 parts) | Dispersion C (15 parts) + Dispersion D (45 parts) + Dispersion E (0.6 part) + Dispersion F (1 part) | Dispersion G (18 parts) |
| Example 7 | Dispersion A (30 parts) + Dispersion B (30 parts) | Dispersion C (45 parts) + Dispersion D (15 parts) + Dispersion E (0.6 part) + Dispersion F (1 part) | Dispersion G (18 parts) |
| Example 8 | Dispersion A (30 parts) + Dispersion H (30 parts) | Dispersion C (30 parts) + Dispersion D (30 parts) + Dispersion E (0.6 part) + Dispersion F (1 part) | Dispersion I (18 parts) |
| Example 9 | Dispersion A (30 parts) + Dispersion B (30 parts) | Dispersion C (30 parts) + Dispersion D (30 parts) + Dispersion E (1.8 part) + Dispersion F (1 part) | Dispersion G (18 parts) |
| Example 10 | Dispersion A (50 parts) + Dispersion B (10 parts) | Dispersion C (30 parts) + Dispersion D (30 parts) + Dispersion E (0.6 part) + Dispersion F (1 part) | Dispersion G (18 parts) |
| Example 11 | Dispersion A (10 parts) + Dispersion B (50 parts) | Dispersion C (30 parts) + Dispersion D (30 parts) + Dispersion E (0.6 part) + Dispersion F (1 part) | Dispersion G (18 parts) |
| Comp Ex 1 | Dispersion A (30 parts) + Dispersion B (30 parts) | Dispersion C (30 parts) + Dispersion D (30 parts) + Dispersion E (0.2 part) + Dispersion F (1 part) | Dispersion G (18 parts) |
| Comp Ex 2 | Dispersion A (30 parts) + Dispersion B (30 parts) | Dispersion C (30 parts) + Dispersion D (30 parts) + Dispersion E (3.0 parts) + Dispersion F (1 part) | Dispersion G (18 parts) |
| Comp Ex 3 | Dispersion A (60 parts) | Dispersion C (30 parts) + Dispersion D (30 parts) + Dispersion E (0.6 part) + Dispersion F (1 part) | Dispersion G (18 parts) |
| Comp Ex 4 | Dispersion H (60 parts) | Dispersion C (30 parts) + Dispersion D (30 parts) + Dispersion E (0.6 part) + Dispersion F (1 part) | Dispersion G (18 parts) |

Example 12

A heat-sensitive recording material was prepared in the same manner as in Example 1 except that 3-di(n-pentyl) amino-6-methyl-7-anilinofluoran was used in place of 3-di (n-butyl)amino-6-methyl-7-anilinofluoran in the preparation of Dispersion C.

Example 13

A heat-sensitive recording material was prepared in the same manner as in Example 1 except that 3-(N-ethyl-N-isoamyl)amino-6-methyl-7-anilinofluoran was used in place of 3-di(n-butyl)amino-6-methyl-7-anilinofluoran in the preparation of Dispersion C.

Example 14

A heat-sensitive recording material was prepared in the same manner as in Example 1 except that 3,3'-diallyl-4,4'-dihydroxy-diphenylsulfone was used in place of 2,4'-dihydroxy-diphenylsulfone in the preparation of Dispersion B.

Example 15

A heat-sensitive recording material was prepared in the same manner as in Example 1 except that 1.0 part of Dispersion F was not used in the preparation of the heat-sensitive recording layer coating composition.

The heat-sensitive recording materials thus obtained were subjected to the evaluation tests described below, and Table 2 shows the results.

Density of Recorded Portion and Gradation Index

The heat-sensitive recording materials were subjected to a 17-step gradation recording by a Video Printer (trade name: UP-880, manufactured by Sony Corporation), and the density of each recorded portion was measured by a Macbeth densitometer (trade name: RD914, manufactured by Macbeth) in visual mode. In Table 2, the difference in density between the recorded portion at Step 6 and the unrecorded portion is referred to as "gradation index". According to the research done by the inventors, if the gradation index (difference in density between the recorded portion at Step 6 and the unrecorded portion) is about 0.3±0.1, excellent gradation is achieved.

Hue

In the above evaluation of the densities of the recorded portions, hue in the recorded portions having a density of about 0.4 to about 0.8 was visually evaluated.

Moisture Resistance Stability (1) Among the recorded portions on the heat-sensitive recording materials after the above recording (i.e., the recording materials subjected to the 17-step gradation recording in the above test of "Density of recorded portion and gradation index"), the recorded portions obtained in steps that gave a density of 0.70 to 0.90 (e.g., Step 9 in Examples and Comparative Examples 1 and 2) were subjected to a density measurement using a Macbeth densitometer in visual mode.

(2) Thereafter, the heat sensitive recording materials were left to stand under the conditions of 40° C. and 90% RH for 24 hours, and then the densities of the recorded portions that had had a density of 0.70 to 0.90 (i.e., recorded portions subjected to a density measurement in item (1) above) were measured again by the Macbeth densitometer in visual mode.

The residual ratios of the densities of said recorded portions were calculated using the following equation $$\text{Residual ratio } (\%)=(D_1/D_0)\times 100$$

where $D_1$ represents the density of the recorded portion after being subjected to the above conditions and Do represents the density of the recorded portion before being subjected to the above conditions.

The residual ratios of the densities of said recorded portions were calculated using the following equation $$\text{Residual ratio } (\%)=(D_2/D_0)\times 100$$

where $D_2$ represents the density of the recorded portion after being subjected to the above conditions and $D_0$ represents the density of the recorded portion before being subjected to the above conditions.

Background Fogging Resistance

The heat-sensitive recording materials were left to stand under the conditions of 50° C. and 30% RH for 24 hours. Then, the background-fogging resistance of the heat-sensitive recording layer was measured by a Macbeth densitometer in visual mode.

TABLE 2

| | Density of recorded portion | | | Heat resistance stability | Moisture resistance Stability | Background fogging resistance | | |
|---|---|---|---|---|---|---|---|---|
| | Gradation index | Step 9 | Step 17 | Residual ratio (%) | Residual ratio (%) | Untreated | 50° C., 30% RH | Hue |
| Example 1 | 0.29 | 0.81 | 1.75 | 114 | 108 | 0.08 | 0.14 | Nearly achromatic black |
| Example 2 | 0.28 | 0.79 | 1.77 | 120 | 154 | 0.08 | 0.15 | Nearly achromatic black |
| Example 3 | 0.25 | 0.77 | 1.77 | 106 | 91 | 0.08 | 0.14 | Nearly achromatic black |
| Example 4 | 0.31 | 0.84 | 1.70 | 120 | 117 | 0.08 | 0.14 | Nearly achromatic black |
| Example 5 | 0.24 | 0.79 | 1.71 | 122 | 119 | 0.08 | 0.12 | Nearly achromatic black |
| Example 6 | 0.28 | 0.76 | 1.71 | 105 | 101 | 0.08 | 0.14 | Nearly achromatic black |
| Example 7 | 0.30 | 0.79 | 1.71 | 122 | 113 | 0.08 | 0.15 | Nearly achromatic black |
| Example 8 | 0.23 | 0.75 | 1.72 | 109 | 102 | 0.08 | 0.14 | Nearly achromatic black |
| Example 9 | 0.24 | 0.75 | 1.72 | 109 | 100 | 0.08 | 0.15 | Nearly achromatic black |
| Example 10 | 0.35 | 0.83 | 1.70 | 127 | 109 | 0.08 | 0.13 | Nearly achromatic black |
| Example 11 | 0.23 | 0.74 | 1.79 | 100 | 85 | 0.08 | 0.14 | Nearly achromatic black |
| Example 12 | 0.30 | 0.80 | 1.75 | 117 | 104 | 0.08 | 0.14 | Nearly achromatic black |
| Example 13 | 0.33 | 0.81 | 1.78 | 127 | 121 | 0.10 | 0.25 | Nearly achromatic black |
| Example 14 | 0.35 | 0.85 | 1.79 | 111 | 108 | 0.09 | 0.20 | Slightly greenish black |
| Example 15 | 0.21 | 0.75 | 1.68 | 112 | 105 | 0.08 | 0.14 | Nearly achromatic black |
| Comp Ex 1 | 0.29 | 0.80 | 1.75 | 114 | 108 | 0.08 | 0.14 | Greenish black |
| Comp Ex 2 | 0.24 | 0.75 | 1.72 | 108 | 101 | 0.08 | 0.18 | Reddish black |
| Comp Ex 3 | 0.12 | 0.28 | 1.53 | 81 | 42 | 0.07 | 0.12 | Nearly achromatic black |
| Comp Ex 4 | 0.11 | 0.26 | 1.38 | 83 | 45 | 0.07 | 0.12 | Nearly achromatic black |

Heat Resistance Stability (a) Among the recorded portions on the heat-sensitive recording materials after the above recording (i.e., the recording materials subjected to the 17-step gradation recording in the above test of "Density of recorded portion and gradation index"), the recorded portions obtained in steps that gave a density of 0.70 to 0.90 (e.g., Step 9 in Examples and Comparative Examples 1 and 2) were subjected to a density measurement using a Macbeth densitometer in visual mode.

(b) Thereafter, the heat sensitive recording materials were left to stand under the conditions of 50° C. and 30% RH for 24 hours, and then the densities of the recorded portions that had had a density of 0.70 to 0.90 (i.e., recorded portions subjected to a density measurement in item (a) above) were measured again by the Macbeth densitometer in visual mode.

FIG. 1 is a graph showing the relationship between the intensity of the recording energy applied (energy applied by a Video Printer in the above 17-step gradation recording) and the density of the recorded portion with respect to the heat-sensitive recording materials of Example 1 and Comparative Example 3.

As is clear from FIG. 1, the heat-sensitive recording material of Comparative Example 3 which, unlike the present invention, contains only one kind of developer has a recording density of only about 0.19 at Step 6, and the gradation index (difference in density between the recorded portion at Step 6 and the unrecorded portion) is only 0.12. Further, compared to the low densities of the recorded portions up to Step 9, the densities of the recorded portions substantially increase after Step 9. As a result, when all 17 steps are considered, the graph showing the relationship between the intensity of the recording energy applied and the density of the recorded portions is not a straight line but a curved line, indicating an inferior gradation property.

On the contrary, the heat-sensitive recording material of Example 1 of the invention has a recording density of about 0.37 at Step 6, and the gradation indx (difference in density between the recorded portion at Step 6 and the unrecorded portion is 0.29, which is within the difference in density range of 0.3±0.1. When all 17 steps are considered, the graph showing the relationship between the intensity of the recording energy applied and the density of the recorded portions is a substantially straight line, indicating an excellent gradation property.

As seen from the column on Table 2 showing the densities of the recorded portions at Step 17, the heat-sensitive recording materials of Examples 1 to 15 have saturation densities (maximum densities of the recorded portions) greater than those of the heat-sensitive recording materials of Comparative Examples.

INDUSTRIAL APPLICABILITY

As demonstrated in Table 2, the heat-sensitive recording material of the invention gives recorded portions having nearly achromatic black color, is excellent in density of recorded portions (recording sensitivity), gradation and background-fogging resistance, has high saturation density of the recorded portion (maximum density of recorded portion), and further has excellent heat resistance and moisture resistance, resulting in less change over time in density.

What is claimed is:

1. A heat-sensitive recording material comprising (a) a supporting and (b) a heat-sensitive recording layer formed on the support and containing a leuco dye, a developer and a binder, the heat-sensitive recording layer containing a mixture of 4-hydroxy-4'-isopropoxy-diphenylsulfone and at least one member selected from the group consisting of 2,4'-dihydroxy-diphenylsulfone and 4,4'-dihydroxy-diphenylsulfone as the developer and a black-color-forming leuco dye and a red-color-forming leuco dye as the leuco dye, the red-color-forming leuco dye being present in an amount of 0.5 to 3.5 wt. % relative to the black-color-forming leuco dye, the black-color-forming leuco dye being at least one member selected from the group consisting of 3-di(n-butyl)amino-6-methyl-7-anilinofluoran, 3-di(n-pentyl) amino-6-methyl-7-anilinofluoran and 3-di (n-butyl) amino-7-(o-chloroanilino)fluoran, and the red-color-forming leuco dye being 3-diethylamino-7-chiorofluoran.

2. The heat-sensitive recording material according to claim 1 wherein said at least one member selected from the group consisting of 2,4'-dihydroxy-diphenylsulfone and 4,4'-dihydroxy-diphenylsulfone is used in an amount of about 0.5 to about 2.0 parts by weight per part by weight of 4-hydroxy-4'-isopropoxy-diphenylsulfone.

3. The heat-sensitive recording material according to claim 1 wherein the black-color-forming leuco dye is a mixture of 3-di(n-butyl)amino-7-(o-chloroanilino)fluoran and at least one member selected from the group consisting of 3-di(n-butyl)amino-6-methyl-7-anilinofluoran and 3-di (n-pentyl)amino-6-methyl-7-anilinofluoran.

4. The heat-sensitive recording material according to claim 3 wherein 3-di(n-butyl)amino-7-(o-chloroanilino) fluoran is used in an amount of 30 to 300 wt. % relative to at least one member selected from the group consisting of 3-di(n-butyl)amino-6-methly-7-anilinofluoran and 3-di(n-pentyl)amino-6-methyl-7-anilinofluoran.

5. The heat-sensitive recording material according to claim 1 which contains the red-color-forming leuco dye in an amount of about 0.8 to about 3.0 wt. % relative to the black-color-forming leuco dye.

6. The heat-sensitive recording material according to claim 1 wherein the heat-sensitive recording layer further comprises a blue-color-forming leuco dye in an amount of about 0.5 to about 5 wt. % relative to the black-color-forming leuco dye.

7. The heat-sensitive recording material according to claim 1 wherein a water dispersible resin is contained as the binder in the heat-sensitive recording layer.

8. The heat-sensitive recording material according to claim 1 wherein the heat-sensitive recording layer further comprises a sensitizer, a print stability-improving agent or a mixture thereof.

9. The heat-sensitive recording material according to claim 1 which further comprises a protective layer on the heat-sensitive recording layer.

10. The heat-sensitive recording material according to claim 1 which contains the red-color-forming leuco dye in an amount of 0.5 to about 3.0 wt. % relative to the black-color-forming leuco dye.

* * * * *